US006231381B1

(12) United States Patent
Kuo et al.

(10) Patent No.: US 6,231,381 B1
(45) Date of Patent: May 15, 2001

(54) INSULATIVE HOUSING STRUCTURE OF CONNECTOR

(75) Inventors: Ming-Lun Kuo, Taipei; Hsiang-Feng Feng, Yi-Lan, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/344,181

(22) Filed: May 24, 1999

(30) Foreign Application Priority Data

Dec. 15, 1998 (TW) ..... 87220864

(51) Int. Cl.[7] ..... H01R 13/60
(52) U.S. Cl. ..... 439/541.5
(58) Field of Search ..... 439/541.5, 64, 439/101, 79, 92, 80, 377, 444, 638, 640, 631

(56) References Cited

U.S. PATENT DOCUMENTS 4,867,690 * 9/1989 Thumma ..... 439/79
5,024,627 * 6/1991 Bennett et al. ..... 439/631
5,176,523 * 1/1993 Lai ..... 439/64
5,318,452 * 6/1994 Brennian, Jr. et al. ..... 439/79
5,324,204 * 6/1994 Lwee ..... 439/64
5,613,860 * 3/1997 Banakis et al. ..... 439/64
5,643,001 * 7/1997 Kaufman et al. ..... 439/159
5,848,920 * 12/1998 Klein et al. ..... 439/885
5,967,803 * 10/1999 Ho ..... 439/79
6,068,515 * 5/2000 Embo et al. ..... 439/631
6,071,149 * 6/2000 Hara ..... 439/607

* cited by examiner

*Primary Examiner*—Brian Sircus
*Assistant Examiner*—J. F. Duvern
(74) *Attorney, Agent, or Firm*—Wei Te Chung

(57) ABSTRACT

An insulative housing of a PCMCIA card connector includes a header defining a plurality of passageways therein. The passageways are exposed to a rear face of the header for allowing contact elements to be inserted therein from the rear face. The header has a top face forming a post and an opposite bottom face defining a corresponding bore. The post pivotally supports a rocking arm of a card ejection mechanism for releasing a PCMCIA card from the connector. A number of insulative housings may be vertically stacked and precisely positioned with respect to each other by inserting the post of a lower housing into the bore of an upper housing thereby aligning the passageways of the housings. Contact elements fixed to a carrier strip and equally spaced therealong are simultaneously inserted into the passageways of the housings thereby enhancing the efficiency of assembling the PCMCIA card connectors.

11 Claims, 4 Drawing Sheets

INSULATIVE HOUSING STRUCTURE OF CONNECTOR

BACKGROUND OF THE INVENTION

1. Field of the Invention

The present invention generally relates to a PCMCIA card connector, and in particular to an insulative housing structure of a PCMCIA card connector which enhances assembling efficiency of the PCMCIA card connector.

2. The Prior Art

PCMCIA card connectors or card buses are commonly used to expand resources of a computer system. The PCMCIA card connector comprises an insulative housing defining a number of passageways for receiving and retaining contact elements therein. Conventionally, the contact elements are individually inserted into the passageways which is inefficient. It is thus desired to provide an insulative housing structure for the PCMCIA card connector that allows a number of contact elements to be simultaneously inserted into passageways of stacked connector housings thereby enhancing assembling efficiency thereof.

SUMMARY OF THE INVENTION

Accordingly, an object of the present invention is to provide an insulative housing structure for a PCMCIA card connector that enhances assembling efficiency thereof.

Another object of the present invention is to provide an insulative housing structure for a PCMCIA card connector which allows a number of PCMCIA card connector housings to be vertically stacked and precisely positioned with respect to each other whereby passageways of the housings are aligned with each other for simultaneously receiving contact elements therein.

A further object of the present invention is to provide a method for simultaneously inserting a number of contact elements into stacked connector housings for enhancing assembling efficiency.

To achieve the above objects, an insulative housing of a PCMCIA card connector in accordance with the present invention comprises a header defining a plurality of passageways therein. The passageways are exposed to a rear face of the header for allowing contact elements to be inserted therein from the rear face. The header has a top face forming a post and an opposite bottom face defining a corresponding bore. The post pivotally supports a rocking arm of a card ejection mechanism for releasing a PCMCIA card from the connector. A number of insulative housings may be vertically stacked and precisely positioned with respect to each other by inserting the post of a lower housing into the bore of an upper housing thereby aligning the passageways of the housings. Contact elements fixed to a carrier strip and equally spaced therealong are simultaneously inserted into the passageways of the housings thereby enhancing the efficiency of assembling the PCMCIA card connectors.

In accordance with another aspect of the present invention, a method for simultaneously inserting a number of contact elements into passageways defined in insulative connector housings is disclosed. The method comprises the following steps: (a) providing contact elements fixed to a carrier strip and equally spaced from each other therealong; (b) providing connector housings, each housing having a top face and an opposite bottom face and defining at least one passageway therein exposed to a rear face thereof, a post being formed on the top face and a corresponding bore being defined in the bottom face; (c) stacking the connector housings on each other with the bottom face of a first housing positioned on the top face of a second housing whereby the post of the second housing is inserted into the bore of the first housing; (d) simultaneously inserting the contact elements into the passageways of the housings from the rear faces thereof; and (e) removing the carrier strip. By simultaneously inserting a number of contact elements into connector housings assembling efficiency of the connectors is enhanced.

DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
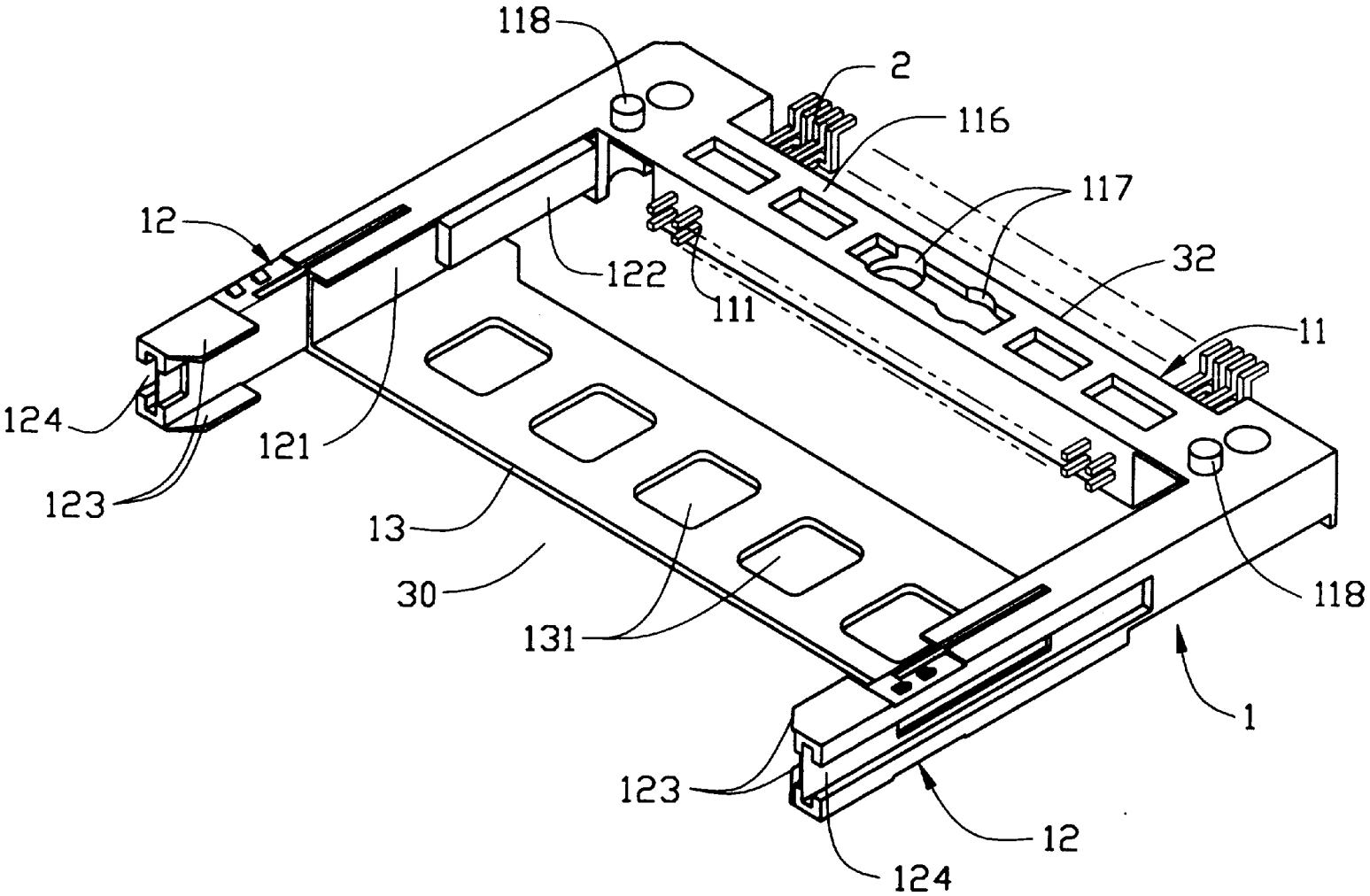
FIG. 1 is a bottom perspective view of an insulative housing of a PCMCIA card connector in accordance with the present invention.
Figure 2:
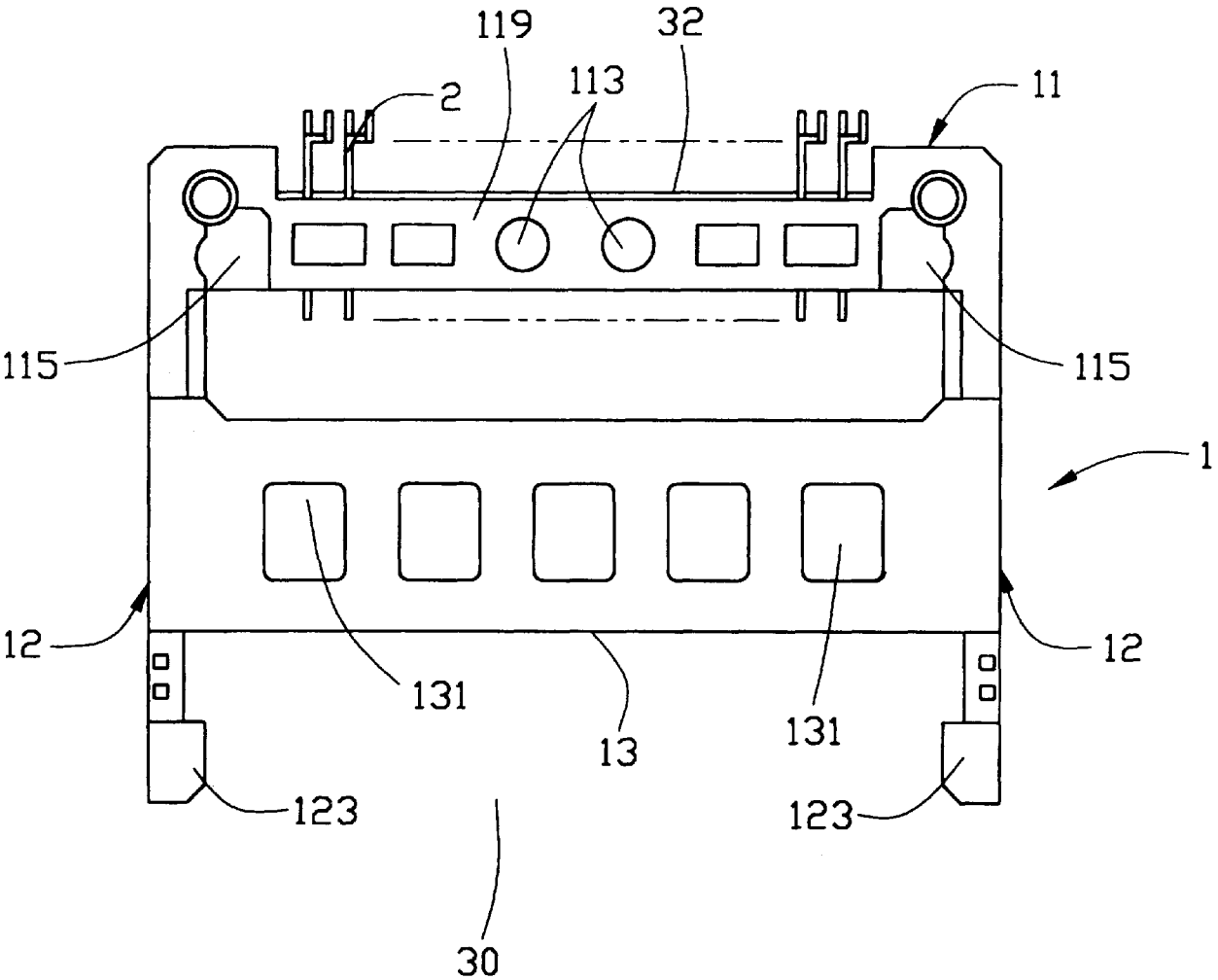
FIG. 2 is a top plan view of FIG. 1.
Figure 3:
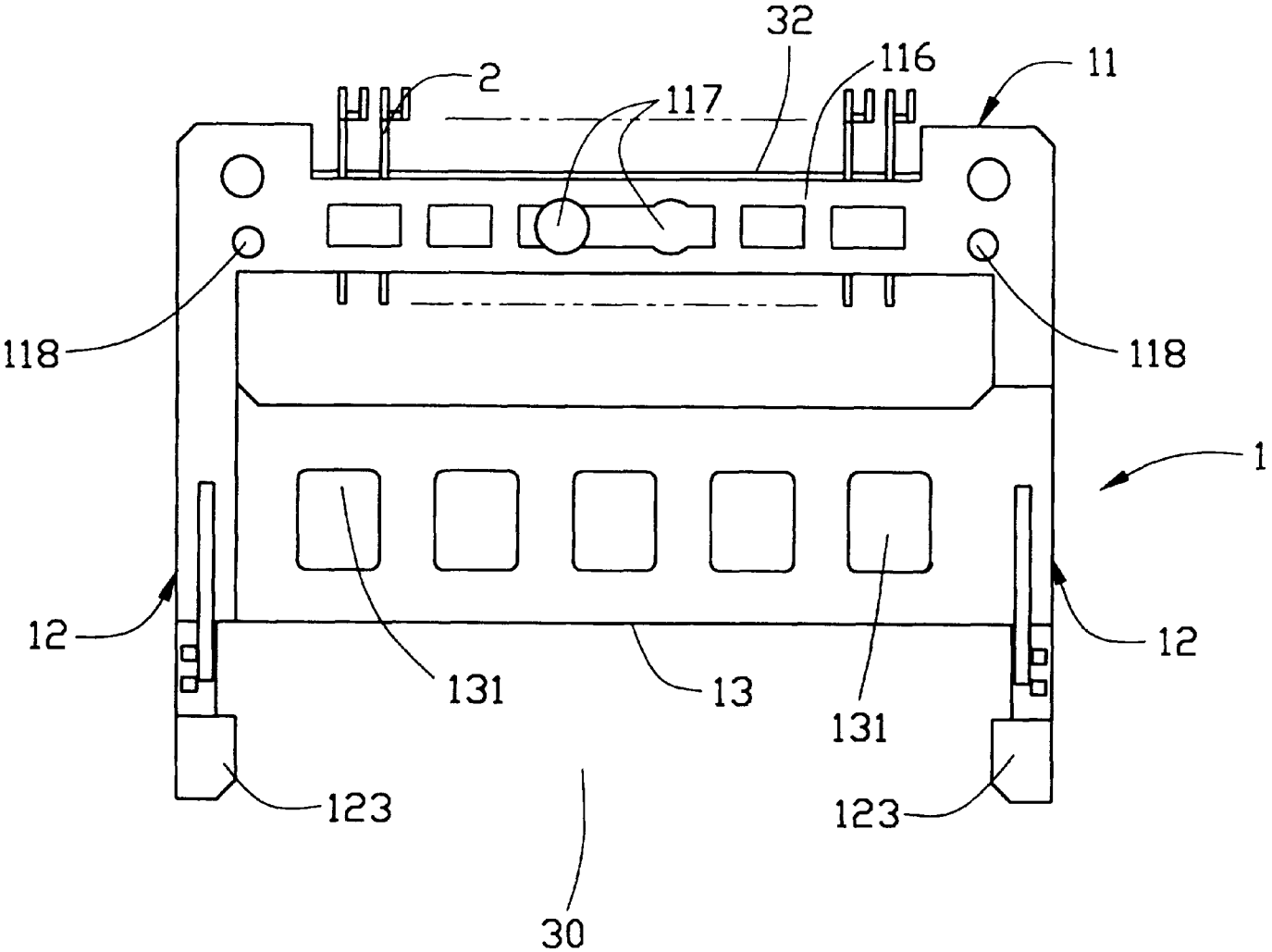
FIG. 3 is a bottom plan view of FIG. 1.

Referring to the drawings and in particular to FIGS. 1–3, an insulative housing 1 of a PCMCIA card connector comprises a header 11 and two opposing guide arms 12 extending from opposite ends of the header 11 to define a space 30 therebetween for receiving a PCMCIA card (not shown). A joining plate 13 is formed between the guide arms 12 on a top side of the insulative housing 1. Openings 131 are defined in the joining plate 13.

Each guide arm 12 has a base wall 121 having an inside face and an outside face (both not labeled). Two opposite flanges 123 are formed on the inside face of the base wall 121 and define a channel (not labeled) for receiving and guiding the PCMCIA card into the space 30 between the guide arms 12. A block 122 is disposed on the inside face of the base wall 121 for correctly positioning the PCMCIA card inserted into the space 30.

A slot 124 is defined in the outside face of the base wall 121 for selectively receiving a push bar of a card ejection mechanism (not shown). The card ejection mechanism removes the PCMCIA card out of the connector and comprises a rocking arm (not shown) pivotally supported on a trunnion 113. The push bar is assembled to the rocking arm and is manually movable to drive the rocking arm to release the PCMCIA card.

The header 11 defines a plurality of passageways 111 for receiving and retaining contact elements 2 therein. Each contact element 2 has a first end (not labeled) inserted into the passageways from a rear face 32 of the header 11 and extending into the space 30 with a second end (not labeled) extending beyond the rear face 32 of the header 11 for connecting to a circuit board (not shown).

The header 11 has a top face 119 on which the trunnions 113 are formed. Two openings 115 are also defined in the top face 119. The header 11 has a bottom face 116 opposite the top face 119 on which positioning pins 118 are formed for being received in holes defined in the circuit board to properly position the connector on the circuit board.

Figure 4:
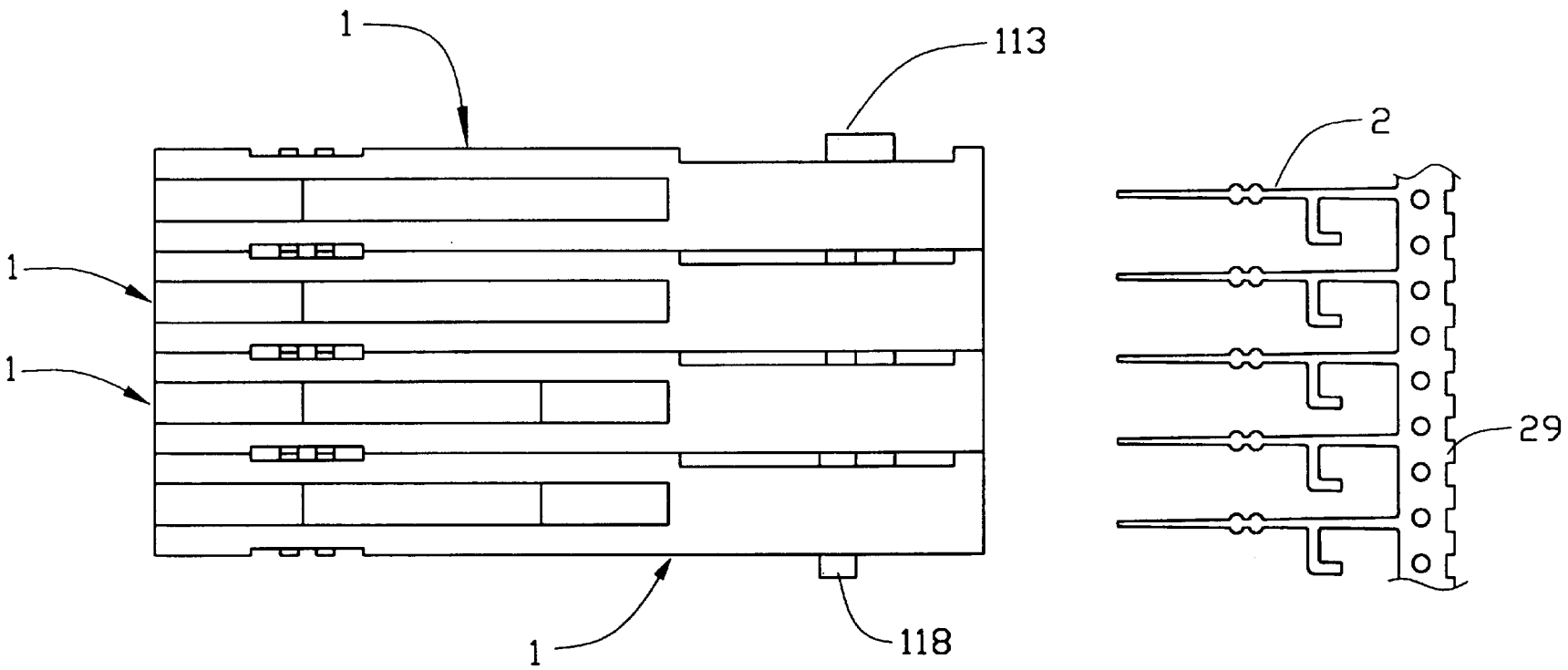
FIG. 4 is a schematic side elevational view showing a number of insulative housings stacked on each other for allowing contact elements to be simultaneously inserted therein.

Bores 117 corresponding in position and size to the trunnions 113 are defined in the bottom face 116 of the header 11. The bores 117 receive the trunnions 113 therein when a plurality of insulative housings 1 are vertically stacked on each other as shown in FIG. 4. The insertion of the trunnions 113 of a first housing 1 into the bores 117 of a second housing 1 allows the housings 1 to be precisely positioned with respect to each other for aligning the passageways of the housings 1.

When the housings 1 are stacked on each other, the openings 115 of the top face 119 provide a space for accommodating the positioning pins 118 of an adjacent upper housing 1.

Precisely stacking a number of housings 1 together allows the contact elements 2 to be inserted into the headers 11 simultaneously whereby the PCMCIA card connectors may be efficiently assembled. Since the formation of the bores 117 in the header 11 does not interfere with the assembly and operation of the PCMCIA card connector and enhances the assembling efficiency thereof, the construction and operation of the PCMCIA card connector are maintained.

As shown in FIG. 4, a number of contact elements 2 are fixed to a carrier strip 29 and are equally spaced from each other therealong. The contact elements 2 are simultaneously inserted into the passageways 111 of the headers 11 of the stacked housings 1. The carrier strip 29 is then removed.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An insulative housing structure of an electrical connector comprising:

a header defining a plurality of passageways therein exposed to a rear face thereof and adapted for insertion of contact elements from the rear face, the header having a top face and an opposite bottom face;

positioning means adapted to precisely position the header of a first insulative housing on the header of a second identical insulative housing with the bottom face of the first insulative housing positioned on the top face of the second insulative housing thereby aligning the passageways of the first insulative housing with the passageways of the second insulative housing for simultaneously inserting contact elements fixed to a carrier strip into the aligned passageways of the first and second housings.

2. The insulative housing structure as claimed in claim 1, wherein the positioning means comprises at least one post formed on the top face of the second insulative housing and a bore defined in the bottom face of the first insulative housing for snugly receiving the post.

3. An insulative housing of a PCMCIA card connector, comprising a header defining a plurality of passageways therein exposed to a rear face thereof and adapted to allow contact elements to be inserted therein from the rear face, the header having a top face and an opposite bottom face;

two opposing guide arms extending from opposite ends of the header to define a space therebetween for receiving a PCMCIA card, the guide arms being adapted to selectively and movably support a card ejection mechanism comprising a rocking arm pivotally supported on a trunnion formed on the top face of the header;

positioning means adapted to precisely position the header of a first insulative housing on the header of a second identical insulative housing with the bottom face of the first insulative housing positioned on the top face of the second insulative housing thereby aligning the passageways of the first insulative housing with the passageways of the second insulative housing for simultaneously inserting contact elements fixed to a carrier strip into the aligned passageways of the first and second housings.

4. The insulative housing as claimed in claim 3, wherein the positioning means comprises a bore defined in the bottom face of the first insulative housing for snugly receiving the trunnion of the second insulative housing.

5. A method for simultaneously inserting a number of contact elements into passageways defined in insulative connector housings, comprising the following steps:

a. providing contact elements fixed to a carrier strip and equally spaced from each other;

b. providing connector housings, each housing having a top face and an opposite bottom face and defining at least one passageway therein exposed to a rear face thereof, a post being formed on the top face and a corresponding bore being defined in the bottom face;

c. stacking the connector housings on each other with the bottom face of a first housing positioned on the top face of a second housing whereby the post of the second housing is inserted into the bore of the first housing;

d. simultaneously inserting the contact elements into the passageways of the stacked housings from the rear faces thereof; and e. removing the carrier strip.

6. The method as claimed in claim 5, wherein the connector is a PCMCIA card connector, and wherein the post serves as a trunnion for pivotally supporting a card ejection mechanism for releasing a PCMCIA card from the connector.

7. A combination comprising:

more than one electrical connectors stacked with each other, each of said connectors defining a top face, a bottom face and a plurality of passageways extending between and parallel to said top face and said bottom face;

positioning means provided on both the top face and the bottom face for aligning the connectors in the vertical direction; and a carrier strip carrying a plurality of juxtaposed contacts thereon; wherein a distance between every two adjacent contacts is substantially equal to that between a first passage in a first connector and a second passageway in a second connector positioned adjacent to the first connector whereby the two adjacent contacts along the carrier strip can be installed into the corresponding two vertically aligned passageways of the two adjacent connectors.

8. A method for simultaneously inserting a plurality of contact elements into passageways defined in different stacked connector housings, comprising the following steps:

providing contact elements fixed to a carrier strip and equally spaced from each other;

providing a plurality of connector housings each defining a plurality of passageways extending in a first direction;

stacking said connector housings by one another in a second direction perpendicular to said first direction;

providing means for aligning said connector housing along said second direction;

simultaneously inserting the contact elements into the corresponding passageways of the different connector housings wherein said carrier strip extends across all the connector housings along the second direction which is perpendicular to a third direction defined by a lengthwise direction along each of said connector housings; and separating the carrier strip from the contact elements.

9. The method as claimed in claim 8, wherein said means is provided on each of the connector housings.

10. The method as claimed in claim 9, wherein said means is provided on both top and bottom faces of each of the connector housings.

11. The method as claimed in claim 10, wherein said means includes a post formed on the top face and a corresponding bore in the bottom face.

* * * * *